US009268251B2

(12) United States Patent
Okubo

(10) Patent No.: US 9,268,251 B2
(45) Date of Patent: Feb. 23, 2016

(54) IMAGE FORMING APPARATUS

(71) Applicant: CANON KABUSHIKI KAISHA, Tokyo (JP)

(72) Inventor: Kazuhiro Okubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/659,786

(22) Filed: Mar. 17, 2015

(65) Prior Publication Data

US 2015/0277267 A1 Oct. 1, 2015

(30) Foreign Application Priority Data

Mar. 27, 2014 (JP) ..... 2014-066239

(51) Int. Cl.
*G03G 15/043* (2006.01)

(52) U.S. Cl.
CPC ..... *G03G 15/043* (2013.01)

(58) Field of Classification Search
CPC ..... B41J 2/435; G03G 15/04; G03G 15/043
See application file for complete search history.

(56) References Cited

U.S. PATENT DOCUMENTS

2009/0225148 A1* 9/2009 Itami ..... B41J 2/451 347/141
2012/0147119 A1* 6/2012 Toyoizumi ..... G03G 15/04072 347/224

FOREIGN PATENT DOCUMENTS

JP H08-171260 A 7/1996

* cited by examiner

*Primary Examiner* — Sarah Al Hashimi
(74) *Attorney, Agent, or Firm* — Fitzpatrick, Cella, Harper & Scinto

(57) ABSTRACT

An image forming apparatus in which an image is formed on a recording material includes an exposure unit that forms a non-image section potential through exposure of a photoconductor at a first laser power and forms an image section potential through exposure of the photoconductor at a second laser power that is greater than the first laser power. A control unit controls an output of laser power of the exposure unit. The output of the first laser power is controlled during formation of the non-image section potential, so as to be of a first intensity at the middle of an image forming region of the recording material, and to be of a second intensity, stronger than the first intensity, at end sections of the image forming region.

19 Claims, 6 Drawing Sheets

IMAGE FORMING APPARATUS

BACKGROUND OF THE INVENTION

1. Field of the Invention

The present invention relates to an image forming apparatus in which an image is formed on a recording material in accordance with an electrophotographic technology.

2. Description of the Related Art

In electrophotographic image forming apparatuses such as copiers and laser beam printers, an electrostatic image (latent image) is formed through irradiation of light, corresponding to image data, onto an electrophotographic photoconductor (photoconductor drum) that is charged homogeneously by a charging means. Toner (developer) is supplied from a developing assembly to the electrostatic image, and the electrostatic image is made visible in the form of a toner image. The toner image is transferred from the photoconductor to a recording material such as recording paper, by a transfer device. The toner image is then fixed on the recording material in the fixing apparatus, to form a recorded image on the recording material.

Known developing assemblies that are provided in such image forming apparatuses include developing assemblies that rely on a dry one-component developing method. In such a developing assembly, firstly a one-component developer (hereafter, toner) is supported on a developing roller (developer carrier), a uniform toner layer is formed by a layer-thickness regulating member, and the developing roller is brought into contact with the photoconductor. For instance, developing bias voltage formed of a DC component is then applied to the developing roller, to generate a potential difference between the electrostatic image on the photoconductor and the developing roller, and to develop the electrostatic image by causing the toner to move onto the electrostatic image (contact developing scheme).

In image forming apparatuses relying on contact developing schemes, technologies are known in which a potential difference (back contrast) between a photoconductor charging potential and a developing roller applied voltage, and a potential difference (developing contrast) between the developing roller applied voltage and a latent image potential, are appropriately set, to suppress fogging or the like (Japanese Patent Application Publication No. H08-171260).

In a case where the size of the developing device is to be reduced to cope with a reduction in apparatus size, the diameter of the developing roller has to be as small as possible. The developing roller that is pressed against the photoconductor drum deflects readily when the diameter of the developing roller is small. In a configuration where there is provided a toner supply roller for supplying toner to the developing roller, deflection of the developing roller can be suppressed by having the latter supported by the toner supply roller. However, a configuration in which support by a toner supply roller is lacking, through scrapping of the toner supply roller in order to reduce the size and price of the apparatus, entails significantly more pronounced deflection of the developing roller, which is a concern.

Ordinarily, at least the outermost layer of the developing roller is made up of an elastic rubber material, so as not to damage the photoconductor drum. When the developing roller flexes, however, the pressing force is stronger at the end sections than in the central section. As a result, the nip with respect to the photoconductor drum is thicker at the end sections, where the pressing force is strong, than at the central section (the width of the nip section in the recording material conveyance direction is larger at the end sections than at the central section).

In a case where the nip of the developing section was thick, reverse fogging might worsen, since the charge of the toner varied within the nip. Accordingly, the amount of fogging with respect to back contrast might be different between the central section and the end sections, in a case, as described above, where deflection was large and the nip width of the developing roller differed between the central section and the end sections.

FIG. 4 illustrates such a situation. FIG. 4 is a diagram illustrating a relationship between back contrast and fogging amount in a case where the nip width between the developing roller and photoconductor drum differs between the central section and the end sections. As FIG. 4 illustrates, reverse fogging worsens at end sections of large nip width. The value of back contrast for which fogging is minimal differs between the central section and the end sections, due to the influence of worsened reverse fogging. A possibility arose herein in that fogging might occur at paper portions at which the back contrast at the central section and the end sections cannot be optimized due to worsened fogging accompanying toner degradation, in the case of repeated printing over long periods of time using such a developing assembly.

Therefore, an image forming apparatus is demanded that allows suppressing occurrence of fogging yet more effectively.

SUMMARY OF THE INVENTION

A typical configuration of the present invention is characterized in that an image forming apparatus in which an image is formed on a recording material, comprising:

a photoconductor;

an exposure unit that forms a non-image section potential through exposure of the photoconductor at a first laser power, and that forms an image section potential through exposure of the photoconductor at a second laser power that is greater than the first laser power;

a developer carrier that forms a developer image on the photoconductor through deposition of a developer at a region, of the photoconductor, at which the image section potential is formed; and a control unit that controls an output of laser power of the exposure unit, wherein the control unit controls the output of the first laser power during formation of the non-image section potential, so as to be of a first intensity at the middle of an image forming region of the recording material, and to be of a second intensity, stronger than the first intensity, at end sections of the image forming region.

Another typical configuration of the present invention is characterized in that an image forming apparatus in which an image is formed on a recording material, comprising:

a photoconductor;

an exposure unit that forms a non-image section potential through exposure of the photoconductor at a first laser power, and that forms an image section potential through exposure of the photoconductor at a second laser power that is greater than the first laser power;

a developer carrier that forms a developer image on the photoconductor through deposition of a developer at a region, of the photoconductor, at which the image section potential is formed; and a control unit that controls an output of laser power of the exposure unit, wherein the control unit controls the output of the first laser power during formation of the non-image section potential, so as to be gradually stronger from the middle towards end sections of the photoconductor.

Further features of the present invention will become apparent from the following description of exemplary embodiments (with reference to the attached drawings).

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Embodiment 1

The image forming apparatus according to Embodiment 1 of the present invention will be explained next with reference to FIG. 1 to FIG. 5. Herein, the term image forming apparatus (electrophotographic image forming apparatus) refers to an apparatus in which an image is formed on a recording material, by a developer (toner), in accordance with an electrophotographic image forming process. Examples of the image forming apparatus include, for instance, electrophotographic copiers, electrophotographic printers (LED printers, laser beam printers and the like), electrophotographic fax machines and electrophotographic word processors, as well as multifunction machines (multifunction printers) of the foregoing. The term recording material denotes a material on which an image is formed, for instance recording paper, OHP sheets, plastic sheets, fabrics and the like.

The term process cartridge denotes a member resulting from integrating, into a single cartridge, an electrophotographic photoconductor drum and at least one from among a charging device, a developing means and a cleaning means, as process means that act on the electrophotographic photoconductor drum. The process cartridge is configured to be attachable and removable to/from the body of the image forming apparatus. In the explanation below, the term image forming apparatus body (hereafter referred to as "apparatus body") denotes an apparatus constituent part that results from excluding at least the process cartridge and a developing assembly from the configuration of the apparatus body.

<Schematic Configuration of the Image Forming Apparatus>

Figure 2:
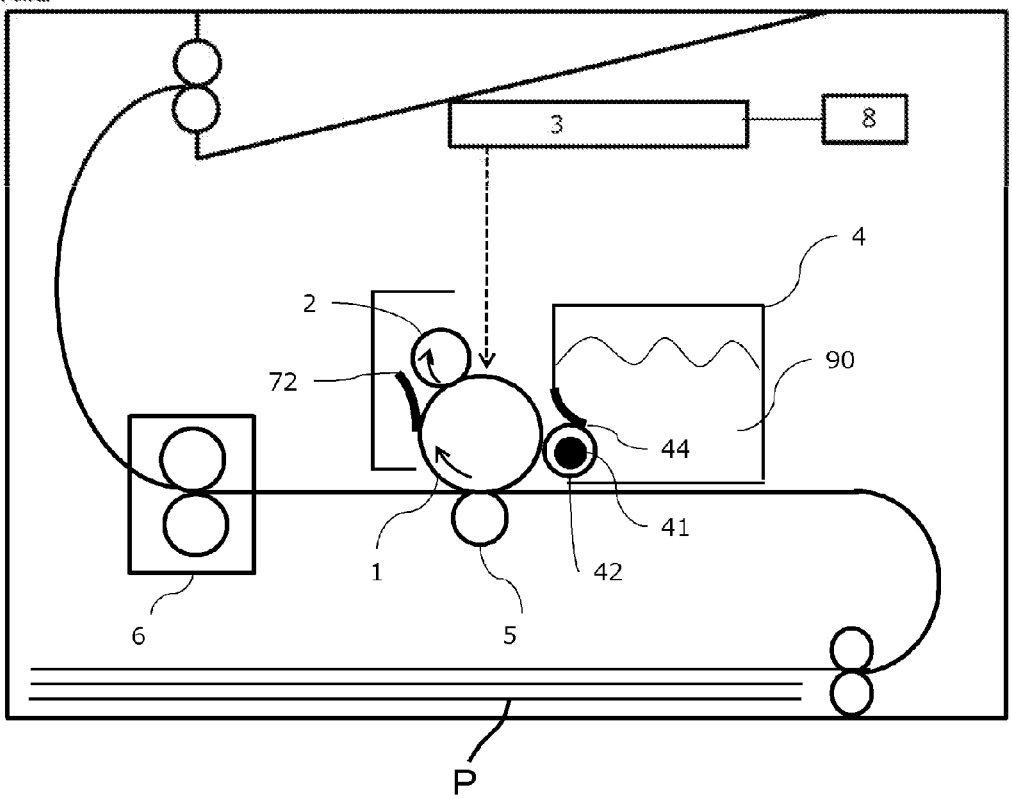
FIG. 2 is a schematic configuration diagram of an image forming apparatus according to an embodiment of the present invention.

FIG. 2 is a schematic cross-sectional diagram illustrating one example of the configuration of an image forming apparatus according to an embodiment of the present invention. In the figure, the reference symbol 1 denotes a cylindrical photoconductor (photoconductor drum), being an image bearing member that rotates about the axis thereof in one direction. The surface of the photoconductor drum 1 is charged uniformly by a charging device (charging roller) 2, and, thereafter, a latent image is formed, by an exposure device (laser exposure unit) 3 as an exposure unit. The developing assembly 4 comprises a hopper, not shown, in which toner 90 is stored, and a developing roller 42, being a developer carrier, that is pressed against the photoconductor drum 1. The latent image formed on the photoconductor drum 1 is made visible through supply of the toner 90 to the latent image. A developing blade 44, as a developer regulating member, is disposed in the vicinity of the developing roller 42.

A developer image on the photoconductor drum 1, made visible by the toner 90, is transferred onto paper, as a recording material (transfer material), by a transfer device 5. The paper, fed by a paper feed roller, is in turn fed into the transfer device 5, in synchrony with the image on the photoconductor drum 1, by a resist roller (not shown). A visible image by the toner 90, transferred to the paper, is conveyed to a fixing apparatus 6, together with the paper, and is fixed by heat or pressure, to yield a recorded image. The untransfered toner 90 that remains on the photoconductor drum 1 after transfer is removed by a cleaning blade 72, and is stored in a waste toner container. Thereafter, the surface of the photoconductor drum 1 is charged again by the charging device 2, and the above-described process is repeated.

The developing assembly 4 accommodates the toner 90 as a one-component developer. The developing assembly 4 is configured so as to come into contact with, and be pressed against, the photoconductor drum 1, inside the developing assembly 4, to develop the electrostatic latent image and make the latter visible in the form of a toner image. The developing assembly 4 has an opening that extends in the longitudinal direction. The above-described developing roller 42 is provided in the opening. The developing roller 42 is made up of a composite member in which a metal core of iron or the like is covered by a rubber layer. The developing roller 42 is disposed so as to rotate and come into contact with the photoconductor drum 1. An elastic blade 44 as a developing regulating member is provided in contact with the developing roller 42, inside the developer container.

<Developing Process>

A developing process sequence will be explained next with reference to FIG. 2. In the developing assembly 40, the toner 90 is caused to gather in the vicinity of the developing roller 42, through rotation of a stirring sheet, not shown, so that the toner 90 is supplied as a result to the developing roller 42. The toner 90 that is supplied to the developing roller 42 is rubbed by the elastic blade 44 and the developing roller 42, and undergoes as a result sufficient triboelectric charging, at a nip section at which the elastic blade 44 and the developing roller 42 are in contact with each other. At a developing section at which photoconductor drum 1 and the developing roller 42 are in contact with each other, a DC developing bias is applied across the developing roller 42 and the photoconductor drum 1, by an application means, not shown. The toner 90 on the developing roller 42 is transferred as a result to the photoconductor drum 1, in accordance with the electrostatic latent image on the photoconductor drum 1, and the toner 90 develops the electrostatic latent image through adhesion to the latter, which is thereby made visible in the form of a toner image. Accompanying the rotation of the developing roller 42, new toner 90 is supplied also at a region at which the toner 90 on the developing roller 42 has been used, and is conveyed to the contact region between the developing roller 42 and the elastic blade 44. The back contrast is set herein to an appropriate value that yields a good image having little fogging.

<Configuration of the Developing Roller>

The metal core of the developing roller used in the present embodiment has a diameter of ϕ5 mm, and the rubber layer has a wall thickness of 2.5 mm and an outer diameter of ϕ10 mm. The hardness of rubber layer was 30°, as measured using a durometer ASKER-MD1, by Kobunshi Keiki Co., Ltd. The length of the metal core is 250 mm and the length of the rubber layer is 230 mm, i.e. the metal core is exposed over 10 mm at either side. In a case where the metal core section of such a developing roller was supported and brought into press-contact with the photoconductor drum, the developing roller deflected and the nip width between the drum and the developing roller was 0.5 mm at the central section, and 1.0 mm at the end sections.

Figure 4:
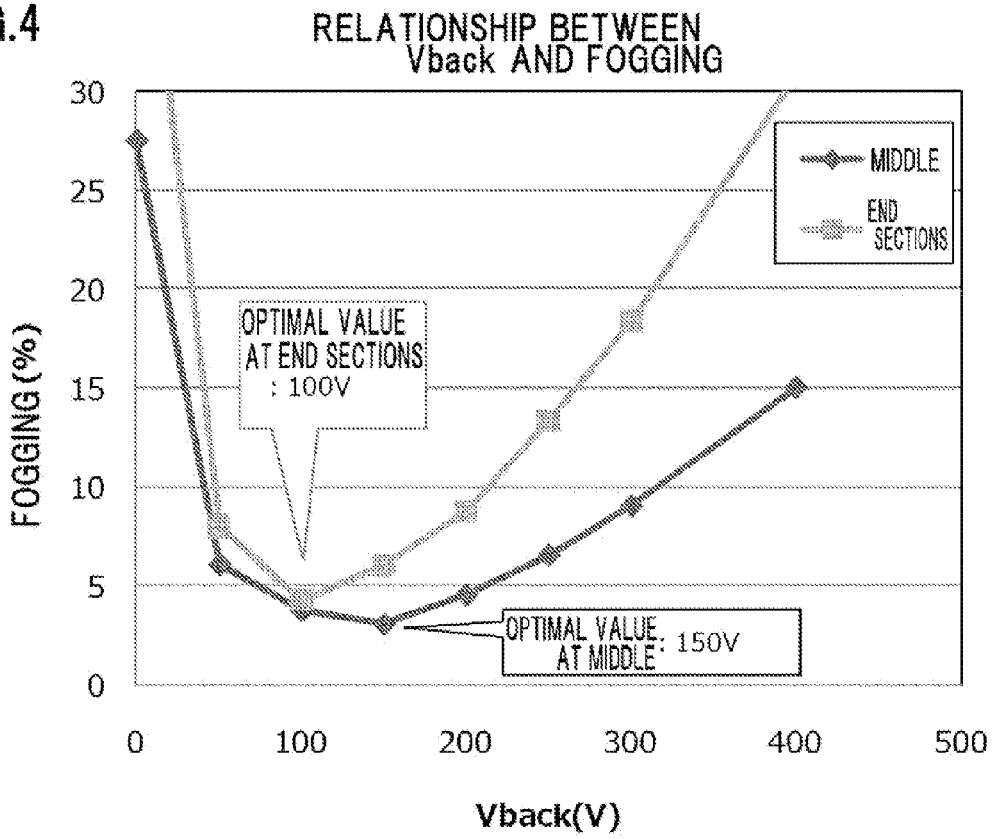
FIG. 4 is a relationship diagram of back contrast and fogging amount.

If the nip of the developing section is thick, the charge of toner varies within the nip, as described above, and reverse fogging may worsen as a result. Further, fogging with respect to back contrast may be different between the central section and the end sections in a case where deflection is large and the nip width differs between the end sections and the central section of a developing roller having a large deflection. FIG. 4 illustrates back contrast and the fogging amount in the central section and the end sections, in a case where the above developing roller of the present embodiment is used. That is, reverse fogging is worse at the end sections of large nip width. Due to the adverse effect of reverse fogging, moreover, the value of back contrast Vback for which fogging is minimal (hereafter also referred to as Vb) is different between the central section and the end sections. Specifically, the optimal back contrast Vb at the central section is 150 V, whereas the optimal back contrast Vb at the end sections is 100 V.

In an experiment of fogging amount illustrated in FIG. 4, the fogging amount in the present embodiment was measured at respective positions, namely with the end sections set to positions about 20 mm from respective edges, and the central section at a position about 108 mm from the edges, for a largest sheet passing width of 216 mm in an A4 printer. The measurement width at each measurement position by the measurement device was set to 10 mm. Specifically, a ±5 mm region, at a position of about 20 mm from a respective edge, was measured in the end section measurement, and a ±5 mm region, at a position about 108 mm from the edges, was measured in the central section measurement.

<Potential Setting of the Present Embodiment>

Figure 3A:
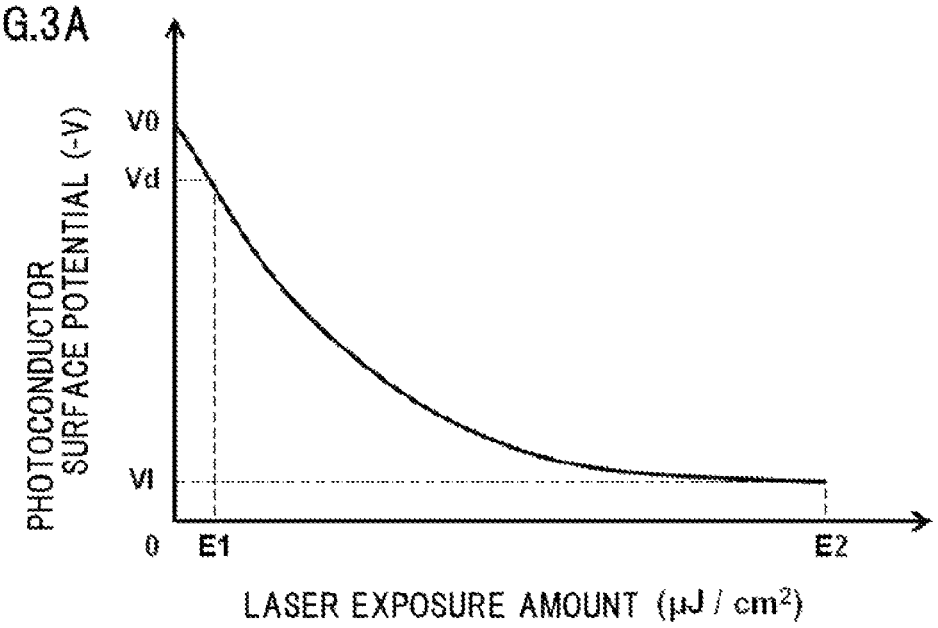
FIGS. 3A and 3B are a set of relationship diagrams of exposure amount and latent image potential.
Figure 3B:
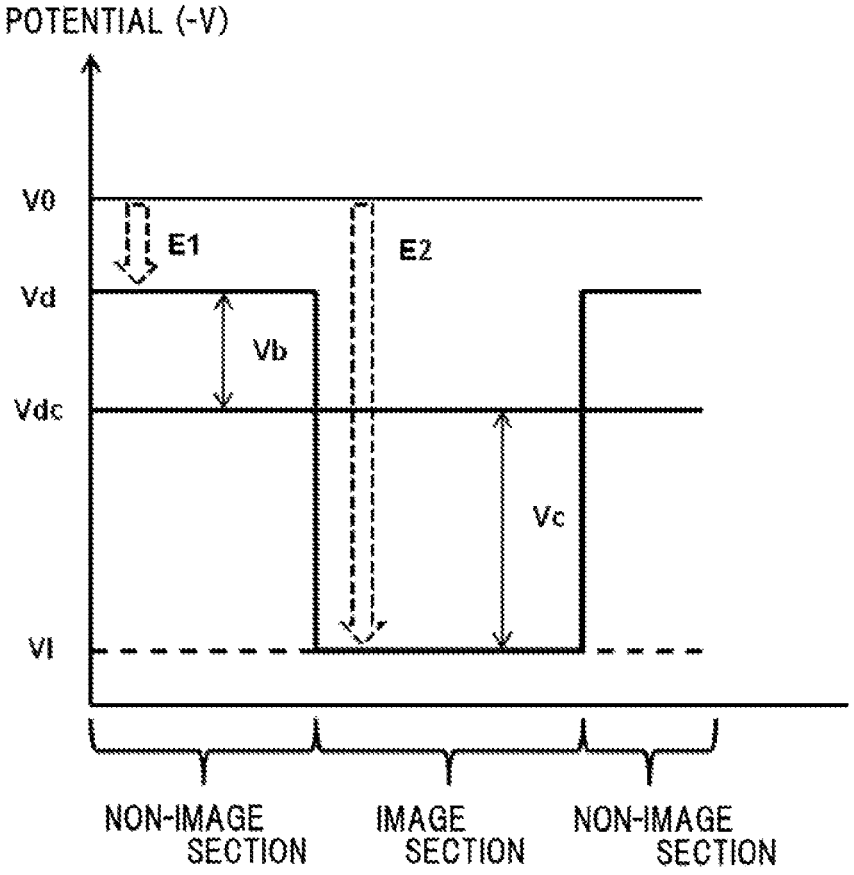

The potential setting upon formation of the electrostatic latent image on the surface of the photoconductor drum 1 of the present embodiment will be explained next with reference to FIG. 3. FIG. 3A is a diagram illustrating a relationship (hereafter referred to as E-V curve) between the surface potential of a photoconductor drum and exposure laser power, depicting herein an E-V curve of a time where the thickness of a photoconductive layer is 15 μm. FIG. 3B is a diagram for explaining potential setting in the present embodiment.

In the exposure device 3, the surface of the charged photoconductor drum 1 is exposed at a first laser power E1 for forming a dark area potential Vd, being a non-image section potential, and at a second laser power E2 for forming a bright area potential Vl, being an image section potential. The region at which the dark area potential Vd is formed corresponds to a non-image section at an image forming region (region at which an image can be formed) on the recording material. In a case where an image is formed on a white-background recording material, specifically, the non-image section is a white background section in the image forming region. That is, the non-image section is a portion, of the photoconductor, that is not irradiated with laser for image formation (laser having the second laser power E2) and is not actively developed.

The region at which the bright area potential Vl is formed corresponds to an image section, in the image forming region on the recording material, specifically, corresponds to a black section of a text or image that is to be formed on the recording material. That is, the region at which the bright area potential Vl is formed is a portion, of the photoconductor, at which text or images are drawn through active development by irradiation of laser having an intensity (E2) for image formation.

A desired electrostatic latent image is formed on the surface of the photoconductor drum 1 through exposure by the exposure device 3. As a characterizing feature of the present embodiment, the first laser power E1 is gradually increased, continuously, from the image central section over the end sections, to make thereby the dark area potential of the end sections lower than the dark area potential of the central section; as a result, there is formed back contrast of least fogging at both the central section and the end sections.

The photoconductor drum 1 is a so-called organic photoconductor wherein a charge generation layer is formed on a cylindrical substrate made of aluminum, and a charge transport layer is formed on the charge generation layer. The outer diameter of the photoconductor drum 1 of the present embodiment is 24 (mm). Upon start of the image forming process, DC voltage equal to or greater than the discharge starting voltage is applied to the charging roller 2, as a charging device, having an outer diameter of 8 (mm), and there is formed a primary charging potential V0 on the surface of the photoconductor drum 1. In DC charging, charging potential is formed linearly with respect to the applied voltage when voltage equal to or greater than the discharge starting voltage is formed on the charging roller 2.

The exposure device (laser exposure unit) 3 has a known configuration wherein exposure is performed using a laser diode (light source) and a polygon mirror (rotating polygon mirror). A laser beam outputted, by the laser diode, and modulated in accordance with an image signal, is collimated, is scanned by the polygon mirror, and passes through a series of lens groups, to be irradiated thereafter onto the photoconductor drum 1. Through modification of the degree of intensity of emission by the laser diode (modification of the current amount), it becomes possible to modify the exposure amount in the scanning direction, i.e. a direction (image width direction) that is perpendicular to the conveyance direction of the recording material, and to form, on the surface of the photoconductor drum 1, potential that varies in the image width direction.

In the present embodiment, the exposure device 3 is configured to be capable of switching between two standard output values, namely, the first laser power E1 and the second laser power E2 as the laser output at the time of exposure of the surface of the photoconductor drum 1, and outputting the first laser power E1 or the second laser power E2. That is, the exposure device 3 comprises a laser power control unit (CPU) 8 as a control unit that controls the laser power that is outputted by the exposure device 3 according to the image section and the non-image section. The laser power control unit 8 of the present embodiment selects individually the first laser power E1 as the laser power for the dark area potential Vd, for the non-image section, and the second laser power E2 as the laser power for the bright area potential Vl, for the image section. In the image forming process of the present embodiment, a predetermined current is caused to flow through the laser diode, to bring thereby the laser to weak emission that is thus set as the first laser power E1. The second laser power E2 is set, for the image forming section, by causing a desired current to flow so as to increase the emission amount to be greater than that during weak emission. The laser power control unit 8 variably controls the current amount that flows through the laser diode, to control thereby the laser power E1 and E2.

In FIG. 3A, the abscissa axis of the graph represents the exposure laser power E ($\mu J/cm^2$) received by the surface of the photoconductor drum 1, and the ordinate axis represents the surface potential V (−V) of the photoconductor drum 1 at the time at which that laser power is received. The surface speed of the photoconductor drum 1 is 150 (mm/sec). The bright area potential Vl is formed through exposure of the image forming section of the photoconductor drum 1, by the exposure device 3, at the second laser power E2 ($\mu J/cm^2$). Simultaneously therewith, the dark area potential Vd is formed through exposure of the non-image forming section (background), at the first laser power E1 ($\mu J/cm^2$) that is smaller than the second laser power E2. A predetermined DC voltage is applied to the developing roller, and, as a result, the electrostatic latent image is reverse-developed, in the form of a toner image, on account of the potential difference between the bright area potential Vl on the photoconductor drum and a developing bias voltage Vdc, by the negatively chargeable toner that is transported to the developing position.

In the image forming apparatus according to the present embodiment, the photoconductor drum 1 is charged by the charging roller 2 through negative charging; herein, a reverse development scheme is resorted to in which developing is accomplished using negatively charged toner. Therefore, the region exposed at the second laser power E2 ($\mu J/cm^2$) is the image section, while the region exposed at the first laser power E1 ($\mu J/cm^2$) constitutes the white background section (background).

FIG. 3B is a diagram for explaining potential setting. Herein, a developing contrast Vc being a difference between the bright area potential Vl and the developing bias voltage Vdc is one factor pertaining to setting of the image concentration in the image section. Specifically, sufficient image concentration cannot be obtained if the developing contrast Vc is small. A predetermined or higher value of developing contrast Vc must accordingly be secured. The back contrast Vb, which is the difference between the developing bias voltage Vdc and the dark area potential Vd, is a defining factor of, among others, the amount of so-called "fogging" (background staining) in the white background section. If the back contrast Vb increases beyond a predetermined value, reversely charged toner (i.e. positively charged toner) adheres to the white background section, giving rise to fogging, image dirt, machine contamination and the like. When, on the other hand, the back contrast Vb drops below a predetermined value, toner of positive polarity (i.e. negatively charged toner), is developed at the white background section, which gives similarly rise to fogging. Accordingly, the back contrast Vb must be set within a predetermined range in order to minimize fogging.

Figure 1:
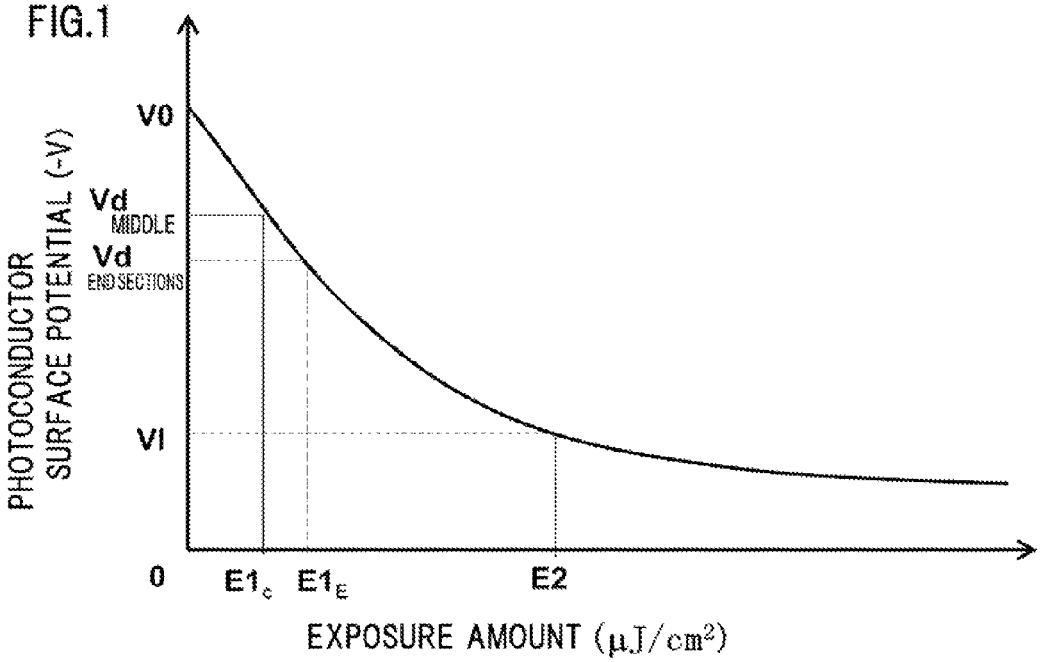
FIG. 1 is a relationship diagram of laser power $E1_C$, $E1_E$ and E2, and photoconductor surface potential.

FIG. 1 illustrates a relationship between $E1_C$ as the first laser power that is used in the image central section of the present embodiment, $E1_E$ as the first laser power that is used in the image end sections, and the second laser power E2. In the present embodiment, the output of the first laser power is controlled to $E1_C$ (first intensity) at the middle of the image forming region of the recording material, and to $E1_E$ (second intensity), stronger than $E1_C$, at the end sections.

Figure 5:
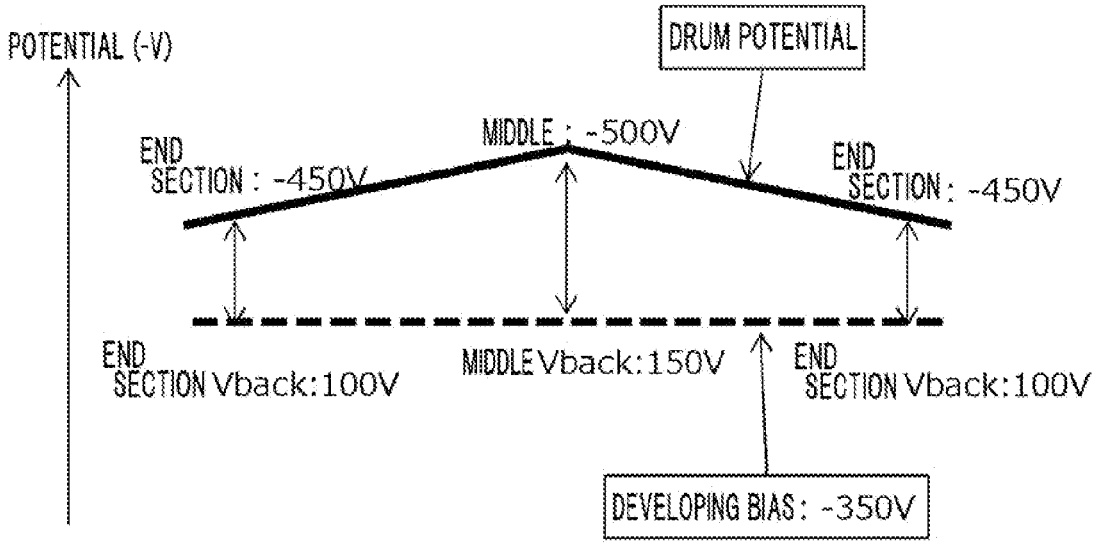
FIG. 5 is a relationship diagram of potential and longitudinal direction in a photoconductor drum.

FIG. 5 is a schematic diagram illustrating the relationship between the potential formed on the photoconductor drum, through control of the laser power according to the present embodiment, and the longitudinal direction of the photoconductor drum. In the present embodiment, the V0 potential is set to −600 V, the central section of the image forming region is exposed at $E1_C$, with the dark area potential of the central section set to −500 V, and the end sections are exposed at $E1_E$, with the dark area potential of the end sections set to −450 V. As a result, 150 V (first back contrast), being aback contrast Vb of optimal magnitude (absolute value), is formed at the central section of the image forming region. Further, 100V (second back contrast), being aback contrast Vb of optimal magnitude, is formed at the end sections of the image forming region. Fogging at the end sections and the central section of the image forming region is optimized as a result, and a good image can thus be formed.

In the present embodiment, the output of laser power is controlled in such a manner that the back contrast Vb takes on a longitudinally appropriate value, through linear interpolation of the first laser power intensity at the end sections and the central section. Various methods can be resorted to herein concerning the laser power that is irradiated onto regions that lie between the image end sections and the image central section, so long as the method allows optimizing fogging. Examples of such methods include, for instance, a method that involves switching between the $E1_C$ and $E1_E$ intensities, at a location between the image end sections and the central section, a method that involves using laser power that is obtained through linear interpolation of the $E1_C$ and $E1_E$ intensities, or a method that involves using the laser power resulting from quadratic function interpolation. Specifically, the output of laser power can be controlled in such a manner so as to be $E1_C$ within a predetermined range from the end sections of the image forming region, and to be $E1_E$ at a range excluding the predetermined range. The output of laser power can be controlled in such a manner that a first predetermined range that includes the image forming region is $E1_E$, and a second predetermined range that includes the end sections is $E1_C$. In this case the output of laser power can be controlled in such a manner that laser power increases gradually from $E1_E$ up to $E1_C$, within a range between the first predetermined range and the second predetermined range. Alternatively, the output of laser power can be controlled in such a manner that laser power changes continuously and becomes gradually stronger from $E1_E$ up to $E1_C$. Further, the output of laser power can be controlled in such a manner that laser power changes stepwise and becomes gradually stronger from $E1_E$ to $E1_C$.

Embodiment 2

Figure 6:
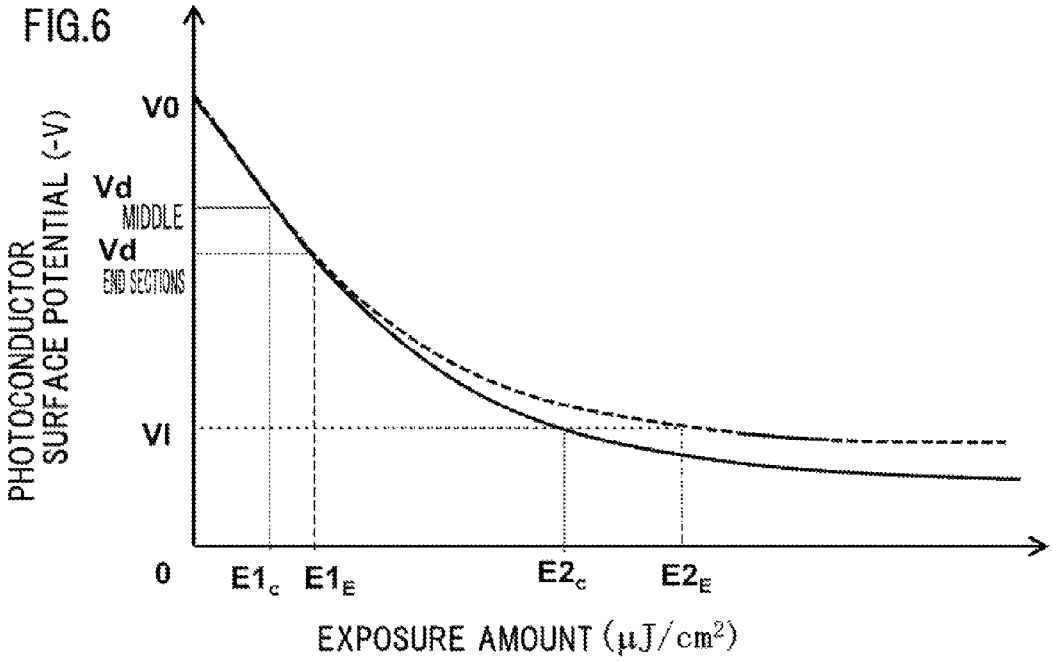
FIG. 6 is a relationship diagram of laser power $E1_C$, $E1_E$, $E2_C$ and $E2_E$, and photoconductor surface potential.

An image forming apparatus according to Embodiment 2 of the present invention will be explained next with reference to FIG. 6. FIG. 6 illustrates a relationship between a central section intensity $E1_C$ and an end section intensity $E1_E$ of first laser power, and a central section intensity $E2_C$ and an end section intensity $E2_E$ of second laser power. Subject matter not explained herein is identical to that in Embodiment 1, and will not be explained again herein.

A latent image potential (Vl) may in some instances increase as a result of the photoconductor drum being exposed over a long period of time. In a case where the photoconductor drum is used repeatedly using the strong first laser power at the end sections, the latent image potential (Vl) at the end sections may become higher than that at the central section. In this case, concentration and line width at the end sections are smaller than those at the central section. Therefore, longitudinal differences can be suppressed, and image quality secured, by increasing the intensity of the second laser power at the end sections according to the operating time of the photoconductor drum.

In addition to control of the output of the first laser power in Embodiment 1, the laser power control unit of the present embodiment controls the second laser power so as to be $E2_C$ (third intensity) at the middle of the image forming region, and $E2_E$ (fourth intensity), stronger than $E2_C$, at the end sections. The output of the second laser power is controlled when the frequency of use of the photoconductor drum 1 exceeds a predetermined frequency. The laser power control unit determines the frequency of use of the photoconductor drum 1 on the basis of, for instance, an image formation count, as well as exposure time and charging voltage application time of the photoconductor drum 1. The index that denotes the frequency of use of the photoconductor drum 1 is not limited to the foregoing.

In the configuration of Embodiment 1, the bright area potential (Vl) at the end sections was 10 V higher than that at the central section upon repeated printing over 10000 prints. Therefore, the bright area potential at the central section and the end sections can be equalized by modifying the intensity of the second laser power at the central section and the end sections, after printing of 10000 prints. Herein, the bright area potential of the end sections and central section can be maintained, yet more homogeneously, through interpolation of the laser power between $E2_C$ and $E2_E$ in accordance with the same method as the method for interpolation of first laser power $E1_C$ and $E1_E$. As a result, fogging at the end sections and the central section of the image forming region can be optimized over time, and a better image can be formed.

The effects of the embodiments above are summarized lastly as follows. The occurrence of fogging can be suppressed more effectively thanks to the features of the image forming apparatuses illustrated in the embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-066239, filed Mar. 27, 2014, which is hereby incorporated by reference herein in its entirety.

What is claimed is:

1. An image forming apparatus in which an image is formed on a recording material, comprising:

a photoconductor;

an exposure unit that forms a non-image section potential through exposure of the photoconductor at a first laser power, and that forms an image section potential through exposure of the photoconductor at a second laser power that is greater than the first laser power;

a developer carrier that forms a developer image on the photoconductor through deposition of a developer at a region, of the photoconductor, at which the image section potential is formed; and a control unit that controls an output of laser power of the exposure unit, wherein the control unit controls the output of the first laser power during formation of the non-image section potential, so as to be of a first intensity at the middle of an image forming region of the recording material, and to be of a second intensity, stronger than the first intensity, at end sections of the image forming region.

2. The image forming apparatus according to claim 1, wherein the first intensity is an intensity such that back contrast, which is an absolute value of a difference between the non-image section potential and an applied voltage of the developer carrier, is a first back contrast at the middle of the image forming region of the recording material, and the second intensity is an intensity such that the back contrast is a second back contrast, smaller than the first back contrast, at the end sections of the image forming region of the recording material.

3. The image forming apparatus according to claim 1, wherein a nip width, in a conveyance direction of the recording material, at a nip section that is formed between the photoconductor and the developer carrier, is a first nip width at the middle of the image forming region, and is a second nip width, larger than the first nip width, at the end sections.

4. The image forming apparatus according to claim 1, wherein the control unit controls the output of the first laser power in such a manner that a predetermined range from the end sections of the image forming region is at the second intensity, and a range excluding the predetermined range is at the first intensity.

5. The image forming apparatus according to claim 1, wherein the control unit controls the output of the first laser power in such a manner that a first predetermined range including the middle of the image forming region is at the first intensity, and a second predetermined range including the end sections is at the second intensity.

6. The image forming apparatus according to claim 5, wherein the control unit controls the output of the first laser power in such a manner that laser power becomes gradually stronger from the first intensity up to the second intensity, in a range between the first predetermined range and the second predetermined range.

7. The image forming apparatus according to claim 6, wherein the control unit controls the output of the first laser power in such a manner that laser power changes continuously and becomes gradually stronger from the first intensity up to the second intensity.

8. The image forming apparatus according to claim 6, wherein the control unit controls the output of the first laser power in such a manner that laser power changes stepwise and becomes gradually stronger from the first intensity up to the second intensity.

9. The image forming apparatus according to claim 1, wherein the control unit controls the output of the second laser power so as to be of a third intensity at the middle of the image forming region of the recording material, and to be of a fourth intensity, stronger than the third intensity, at the end sections.

10. The image forming apparatus according to claim 9, wherein when a frequency of use of the photoconductor exceeds a predetermined frequency, the control unit controls the output of the second laser power so as to be of the third intensity at the middle of the image forming region, and to be of the fourth intensity at the end sections.

11. The image forming apparatus according to claim 10, wherein the control unit determines the frequency of use on the basis of at least one from among an image formation count, an exposure time of the photoconductor, and an application time of charging voltage.

12. An image forming apparatus in which an image is formed on a recording material, comprising:

a photoconductor;

an exposure unit that forms a non-image section potential through exposure of the photoconductor at a first laser power, and that forms an image section potential through exposure of the photoconductor at a second laser power that is greater than the first laser power;

a developer carrier that forms a developer image on the photoconductor through deposition of a developer at a region, of the photoconductor, at which the image section potential is formed; and a control unit that controls an output of laser power of the exposure unit, wherein the control unit controls the output of the first laser power during formation of the non-image section potential, so as to be gradually stronger from the middle towards end sections of the photoconductor.

13. The image forming apparatus according to claim 12, wherein a nip width, in a conveyance direction of the recording material, at a nip section that is formed between the photoconductor and the developer carrier, is a first nip width at the middle of the photoconductor, and is a second nip width, larger than the first nip width, at the end sections.

14. The image forming apparatus according to claim 12, wherein the control unit controls the output of the first laser power in such a manner that laser power changes continuously and becomes gradually stronger from the first intensity up to the second intensity.

15. The image forming apparatus according to claim 12, wherein the control unit controls the output of the first laser power in such a manner that laser power changes stepwise and becomes gradually stronger from the first intensity up to the second intensity.

16. The image forming apparatus according to claim 12, wherein the control unit controls the output of the second laser power so as to be stronger at the end sections than at the middle of the photoconductor.

17. The image forming apparatus according to claim 16, wherein when a frequency of use of the photoconductor exceeds a predetermined frequency, the control unit controls the output of the second laser power so as to be stronger at the end sections than at the middle of the photoconductor.

18. The image forming apparatus according to claim 17, wherein the control unit determines the frequency of use on the basis of at least one from among an image formation count, an exposure time of the photoconductor, and an application time of charging voltage.

19. The image forming apparatus according to claim 12, wherein a back contrast, which is an absolute value of a difference between the non-image section potential and an applied voltage of the developer carrier, becomes gradually smaller from the middle towards the end sections of the photoconductor.

* * * * *